US008478181B2

(12) United States Patent
Ichikawa

(10) Patent No.: US 8,478,181 B2
(45) Date of Patent: Jul. 2, 2013

(54) RECORDING MATERIAL COOLING DEVICE AND IMAGE FORMING APPARATUS

(75) Inventor: Yoshihiko Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 535 days.

(21) Appl. No.: 12/546,078

(22) Filed: Aug. 24, 2009

(65) Prior Publication Data

US 2010/0074663 A1 Mar. 25, 2010

(30) Foreign Application Priority Data

Sep. 24, 2008 (JP) ..... P2008-244075

(51) Int. Cl.
*G03G 15/20* (2006.01)
*G03G 21/20* (2006.01)

(52) U.S. Cl.
USPC ..... 399/341; 399/92

(58) Field of Classification Search
USPC ..... 399/341, 92, 93, 406
See application file for complete search history.

(56) References Cited

U.S. PATENT DOCUMENTS

| | | | | |
|---|---|---|---|---|
| 6,771,926 | B2 * | 8/2004 | Ishikawa et al. | 399/329 |
| 6,920,304 | B2 * | 7/2005 | Kanesawa et al. | 399/328 |
| 7,139,522 | B2 * | 11/2006 | Ohki et al. | 399/384 |
| 2004/0131406 | A1 * | 7/2004 | Ohki et al. | 399/384 |
| 2006/0210333 | A1 * | 9/2006 | Kakishima et al. | 399/341 |

FOREIGN PATENT DOCUMENTS

| | | | |
|---|---|---|---|
| JP | 2003 270987 | A | 9/2003 |
| JP | 2005 17807 | A | 1/2005 |

* cited by examiner

*Primary Examiner* — Walter Lindsay, Jr.
*Assistant Examiner* — Rodney Bonnette
(74) *Attorney, Agent, or Firm* — Morgan, Lewis & Bockius LLP

(57) ABSTRACT

A recording material cooling device includes: a transporting section that transports a recording material; a heat radiation section that radiates heat of the recording material through the transporting section, the heat radiation section coming into contact with the transporting section; an air current generating section that generates an air current which flows through the heat radiation section; and a pair of passages that are respectively located before and after a zone where the transporting section and the heat radiation section are brought into contact with each other, each of the pair of passages being formed on an outer side of the heat radiation section to flow a portion of the air current.

13 Claims, 11 Drawing Sheets

RECORDING MATERIAL COOLING DEVICE AND IMAGE FORMING APPARATUS

CROSS-REFERENCE TO RELATED APPLICATIONS

This application is based on and claims priority under 35 USC 119 from Japanese Patent Application No. 2008-244075 filed on Sep. 24, 2008.

BACKGROUND

Technical Field

The present invention relates to a recording material cooling device and an image forming apparatus.

SUMMARY

According to an aspect of the invention, there is provided a recording material cooling device including: a transporting section that transports a recording material; a heat radiation section that radiates heat of the recording material through the transporting section, the heat radiation section coming into contact with the transporting section; an air current generating section that generates an air current which flows through the heat radiation section; and a pair of passages that are respectively located before and after a zone where the transporting section and the heat radiation section are brought into contact with each other, each of the pair of passages being formed on an outer side of the heat radiation section to flow a portion of the air current.

BRIEF DESCRIPTION OF THE DRAWINGS

Exemplary embodiments of the present invention will be described in detail based on the following figures, wherein.

DESCRIPTION OF REFERENCE NUMERALS AND SIGNS

10: image forming section, 10Y: image forming unit, 10M: image forming unit, 10C: image forming unit, 10K: image forming unit, 11: photoconductor drum, 12: cleaning roll, 13: exposure unit, 14: toner supply unit, 15: transfer roll, 16: feed roll, 100: image forming apparatus, 101: recording material accommodating unit, 102: printing paper, 103: transport path, 104: transport roller mechanism, 105: heating fixing unit, 107: cooling device, 201: heat roll, 202: pressure roll, 203: fixing belt, 204: drive roll, 205: belt cleaning roll, 401: transport belt, 402: transport belt, 403: heat sink, 404: drive roll, 405: tension roll, 406: pressing roll group, 407: drive roll, 408: tension roll, 501: air duct, 502: air duct, 503: outer plate, 504: outer plate, 505: passage, 506: passage, 507: resin plate, 508: resin plate, 510: fan, 511: fan, 512: fan, 521: outer plate, 522: outer plate, 531: projection, 541: projection, 700: cooling device, 701: heat sink, 702: fan, 703: fan, 704: fan

DETAILED DESCRIPTION

Hereafter, a description will be given of an embodiment to which the present invention is applied.

(Configuration of Image Forming Apparatus)

Figure 1:
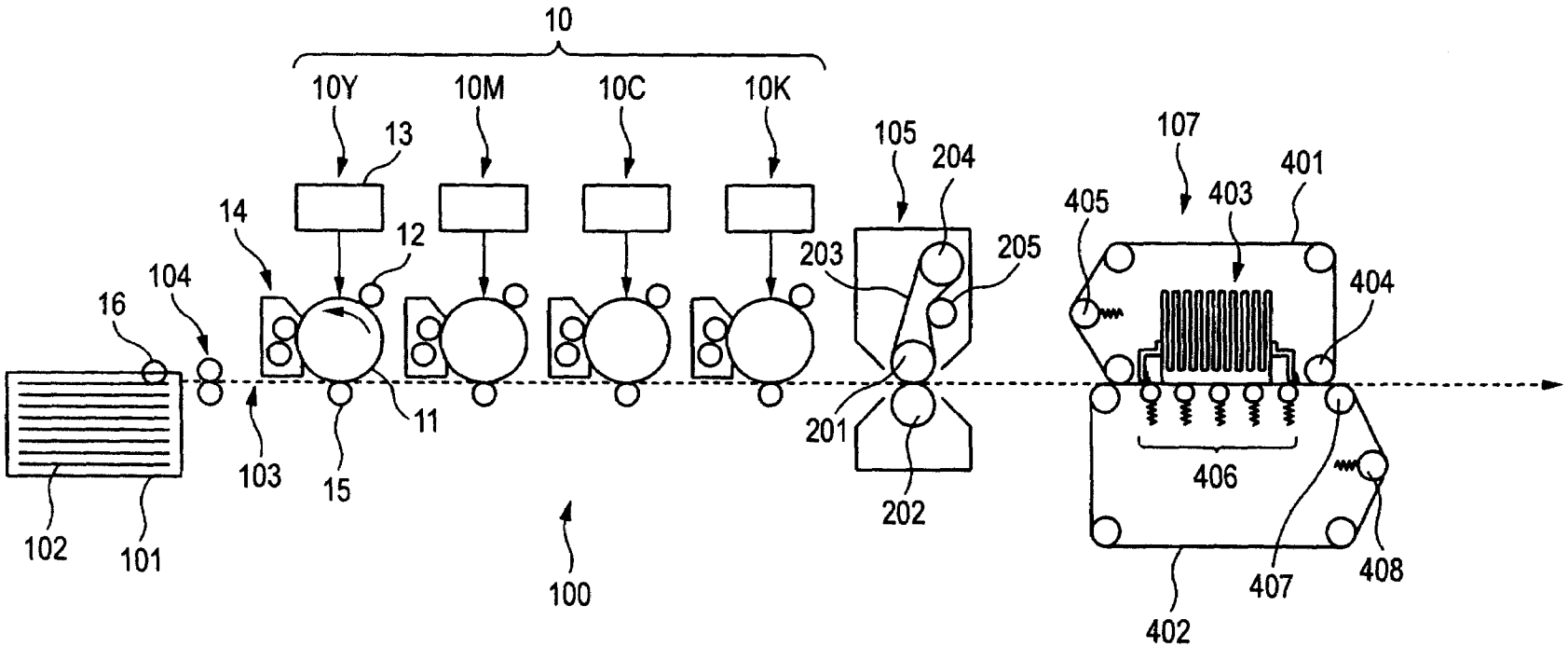
FIG. 1 is a conceptual diagram illustrating an example of an image forming apparatus utilizing the invention.

FIG. 1 shows an image forming apparatus 100 in accordance with the embodiment. The image forming apparatus 100 has a recording material accommodating unit 101. In this example, printing paper 102 which is an example of a recording material is accommodated in the recording material accommodating unit 101. As the recording material, it is also possible to use a resin-made material such as OHP paper other than paper.

Reference numeral 16 denotes a feed roll which is used as a feeding section in this embodiment. The feed roll 16 feeds the printing paper 102 from the recording material accommodating unit 101 to the downstream side. A transport roller mechanism 104 for transporting the printing paper 102 discharged from the recording material accommodating unit 101 is disposed on the downstream side of the recording material accommodating unit 101. An image forming section 10, which is used as an image forming section in this embodiment, is disposed on the downstream side of the transport roller mechanism 104. The image forming section 10 forms a toner image on the printing paper. It should be noted that the phrase "downstream side" referred to herein means a following process side in the flow of processing when viewed in a time series, whereas the phrase "upstream side" conversely means a preceding process side in the flow of processing.

A heating fixing unit 105, which is used as a fixing section in this embodiment, is disposed on the downstream side of the image forming section 10. The heating fixing unit 105 heats and fixes on the printing paper the toner image formed on the printing paper. A cooling device 107 for cooling the printing paper discharged from the heating fixing unit 105 is disposed on the downstream side of the heating fixing unit 105. The printing paper cooled in the cooling device 107 is discharged to an unillustrated discharging section.

(Configuration of Image Forming Section)

Hereafter, a description will be given of the configuration of the image forming section 10 shown in FIG. 10. The image forming section 10 has four image forming units 10Y to 10M for forming toner images of the respective basic colors of Y, M, C, and K on the printing paper.

Since the basic structures of the image forming units 10Y to 10M are identical, a description will be given hereafter of the configuration of the image forming unit 10Y as representing them. The image forming unit 10Y has a photoconductor drum 11. The photoconductor drum 11 rotates in the direction of arrow in the drawing (counterclockwise direction). A cleaning roll 12 for removing the toner remaining on the surface of the photoconductor drum 11 is disposed on the photoconductor drum 11. The surface of the photoconductor drum lion the downstream side of the cleaning roll 12 (on the counterclockwise rotation side in the drawing) is irradiated, while being scanned, with a laser beam for forming an electrostatic latent image from an exposure unit 13. It should be noted that a charging unit (not shown) for charging the photoconductor drum 11 is disposed between this portion where exposure is effected and the cleaning roll 12.

A toner supply unit 14 for supplying the toner onto the surface of the photoconductor drum 11 subjected to exposure and having a latent image formed thereon is disposed on the downstream side of that portion of the photoconductor drum 11 which is exposed. A transfer roll 15 is disposed on the further downstream side thereof in face-to-face relation to the photoconductor drum 11. Described above is the configuration of the image forming unit 10Y. As for the image forming units 10M to 10K, their basic structures are also identical except that toners used are different.

(Operation of the Image Forming Section)

Hereafter, a description will be given of the operation of the image forming units 10Y to 10K. It should be noted that since the operation of the image forming units 10Y to 10K is basically identical except for the colors of the toners, a description will be given herein of the operation of the image forming unit 10Y as representing them.

In the state in which the photoconductor drum 11 is rotating in the counterclockwise direction in the drawing, the toner remaining on its surface is removed by the cleaning roll 12. Further, this portion where the residual toner was removed is subjected to charging with an electrical charge from an unillustrated charger, and this portion is irradiated, while being scanned, with a laser beam from the exposure unit 13. As this irradiation with the laser beam is carried out, the surface of the photoconductor drum 11 becomes photosensitized in a state corresponding to the pattern of an image to be formed, thereby forming an electrostatic latent image.

The toner of the Y color is supplied from the toner supply unit 14 is supplied to the portion where this electrostatic latent image has been formed, and the toner of the Y color is adhered to the surface of the photoconductor drum 11 in correspondence with a charge distribution constituting the electrostatic latent image. A toner image of the Y color is thus formed on the photoconductor drum 11. In tune with the timing of the formation of this toner image, the printing paper discharged from the recording material accommodating unit 101 is fed into a nip between the photoconductor drum 11 and the transfer roll 15. As the printing paper is pinched therebetween, the toner image on the photoconductor drum 11 is transferred onto the printing paper. The surface of the photoconductor drum 11 where the transfer of the toner image was effected is subjected to cleaning by the cleaning roll 12. As the above-described operations are repeated, a toner image of the Y color is formed on the printing paper which is transported along a transport path 103.

Described above is the operation of forming the toner image of the Y color by the image forming unit 10Y, and the formation of toner images of the respective basic colors is also carried out by the image forming units 10M to 10K by similar operation. Thus, the toner images of the basic colors of Y, M, C, and K are sequentially superposed on the printing paper which is transported along the transport path 103 in the rightward direction in the drawing, thereby forming a color toner image.

(Configuration of Heating Fixing Unit)

Next, a description will be given of the configuration of the heating fixing unit 105. The heating fixing unit 105 includes a heat roll 201 and a pressure roll 202 opposing the heat roll 201. The heat roll 201 has a heater in its interior and generates heat. Reference numeral 203 denotes a fixing belt which is stretched between the heat roll 201 and a drive roll 204. A belt cleaning roll 205 for cleaning the surface of the fixing belt 203 is in contact with the fixing belt 203. In addition, the fixing belt 203 at its portion which is in contact with the heat roll 201 is in a state of being pressurized by the pressure roll 202.

(Operation of the Heating Fixing Unit)

Next, a description will be given of the operation of the heating fixing unit 105. When the drive roll 204 rotates in the counterclockwise direction in the drawing, the fixing belt 203 rotates in the counterclockwise direction. In this process, the printing paper which has been transported along the transport path 103 from the left direction in the drawing is brought into a nip between the fixing belt 203 and the pressure roll 202. At this juncture, the toner image formed on the printing paper is heated by the fixing belt 203 and is concurrently pressurized. The fixation of the toner image formed on the printing paper is effected as the pressurization during heating is effected.

(Configuration of the Cooling Unit)

Next, a description will be given of the cooling device 107. As shown in FIG. 1, the cooling device 107 includes a transport belt 401 which is used as a transporting section in this embodiment, as well as a transport belt 402 opposing the transport belt 401. The arrangement provided is such that the transport belt 401 and the transport belt 402 are brought into contact with each other uniformly with respect to the direction perpendicular to the transporting direction of the printing paper such that no such difference between contacting portions and noncontacting portions is created. The transport belt 401 is an example of an endless belt-shaped member, and its surface on the side away from the side which comes into contact with the printing paper is in contact with a heat sink 403 which is used as a heat radiation section in this embodiment. The heat sink is made of a metal (made of aluminum in this example), and is arranged such that a plurality of fins are arranged with gaps, and heat radiation is effected as air flows through the gaps by the action of below-described fans. In a state in which tension is imparted the transport belt 401 by a tension roll 405, the transport belt 401 is rotated by being driven by a drive roll 404.

As for the transport belt 402, its surface on the side away from the side which is brought into contact with the printing paper is pressed by a pressing roll group 406, tension is imparted thereto by a tension roll 408, and the transport belt 402 is rotated by being driven by a drive roll 407. The pressing roll group 406 causes a plurality of rolls to be pressed upward (in the direction toward the heat sink 403) by the repulsive force of springs, to thereby press the transport belt 402 against the transport belt 401 side.

Figure 2:
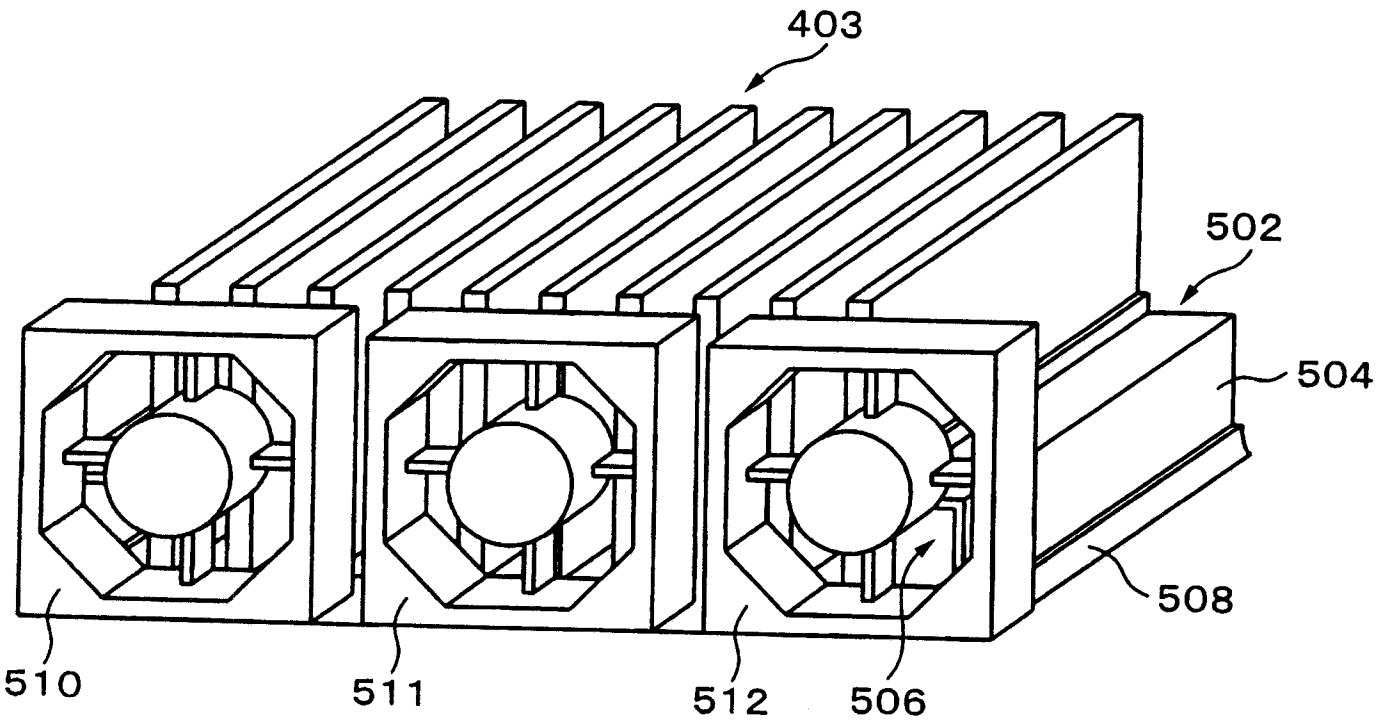
FIG. 2 is a perspective view illustrating an example of a cooling device.
Figure 3:
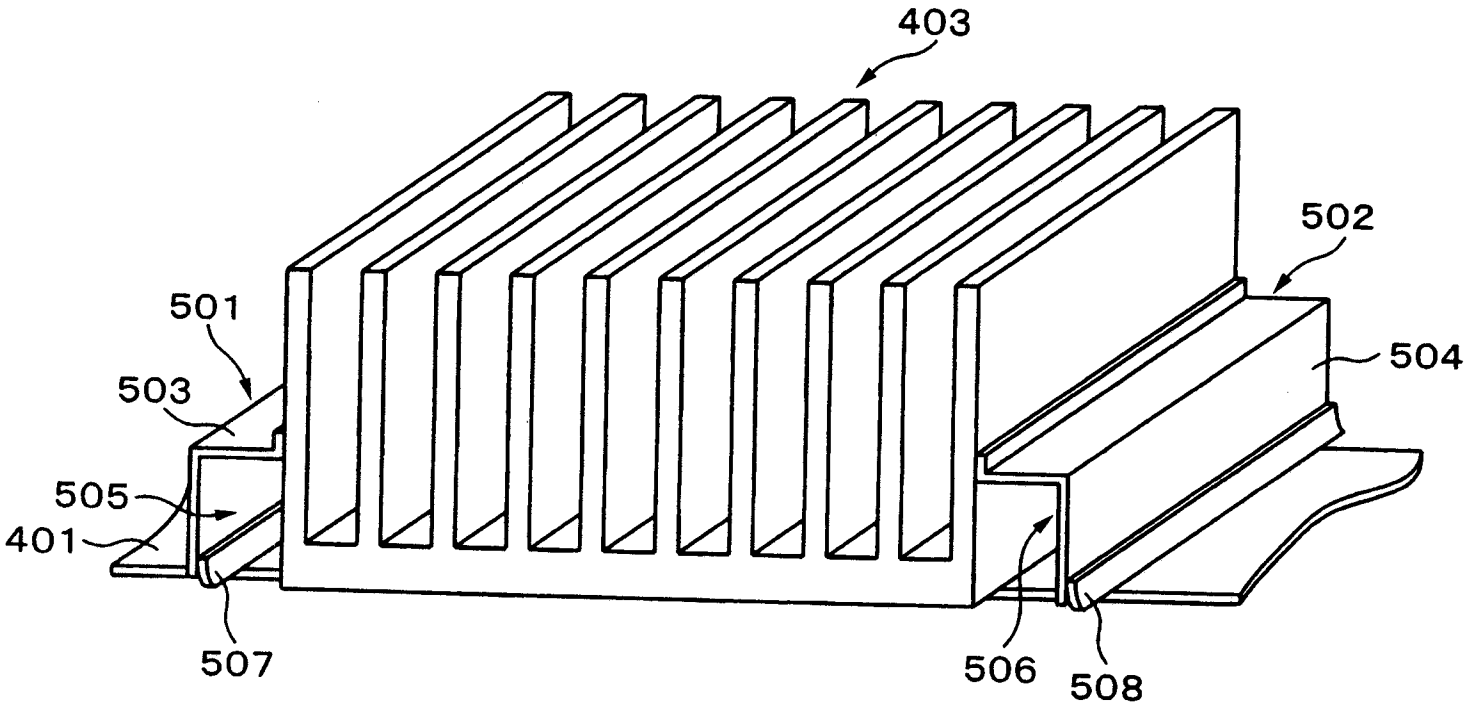
FIG. 3 is a perspective view illustrating an example of the cooling device.

FIG. 2 is a schematic perspective view illustrating the cooling device 107, and FIG. 3 is a perspective view illustrating a state in which cooling fans are removed from the state shown in FIG. 2. It should be noted that, in FIGS. 2 and 3, the illustration of the mechanism of a drive system including the drive roll 404 shown in FIG. 1 is omitted.

The heat sink 403 is shown in FIGS. 2 and 3. As shown in FIG. 2, fans 510 to 512, which are examples of an air current generating section, are disposed on the right side (this side in the drawing) of the heat sink 403 in the paper transporting direction. The fans 510 to 512 are axial flow fans, and the illustration of their blades is omitted in the drawing. The fans 510 to 512 suck air from the heat sink 403 side and exhausts the air current to this side in the drawing. It should be noted that the direction of the flow of the air current may be reverse.

The lower surface of the heat sink 403 is in contact with the transport belt 401 (this arrangement being not shown in FIG. 2). The transport belt 401 in the state of being in contact with the heat sink 403 moves in the direction from left to right in the drawing. Air ducts 501 and 502 are respectively provided on the upstream side and the downstream side of the heat sink 403. The air ducts 501 and 502 are so structured that outer plates 503 and 504 obtained by bending metal plates into the illustrated shapes are respectively fixed to the heat sink 403.

More specifically, in the air duct 501, a space which is surrounded by the outer plate 503, the heat sink 403, and the transport belt 401 serves as a passage 505 which is used as a passage in this embodiment. The passage 505 is disposed on the upstream side of the heat sink 403 in such a manner as to extend in the direction of traversing the transport belt 401 along that edge portion of the heat sink 403 which comes into contact with the transport belt 401. An edge of the outer plate 503 is not brought into contact with the transport belt 401, and its gap is closed by a resin plate 507 (a PET film in this example) which is an example of a gap closing member. The resin plate 507 is fixed to the downstream side of the edge of the outer plate 503.

In the air duct 502, a space which is surrounded by the outer plate 504, the heat sink 403, and the transport belt 401 serves as a passage 506 which is used as a passage in this embodiment. The passage 506 is disposed on the downstream side of the heat sink 403 in such a manner as to extend in the direction of traversing the transport belt 401 along that edge portion of the heat sink 403 which comes into contact with the transport belt 401. An edge of the outer plate 504 is not brought into contact with the transport belt 401, and its gap is closed by a resin plate 508 (a PET film in this example) which is an example of a gap closing member. The resin plate 508 is fixed to the downstream side of the edge of the outer plate 504.

The resin plates 507 and 508 are set in a state of being brought into contact with the transport belt 401 in a state in which the resin plates 507 and 508 are curved with a force applied thereto, so as to be structured to prevent the leakage of air current from between the resin plate and the transport belt. In addition, those edge portions of the resin plates 507 and 508 which are brought into contact with the transport belt 401 are each provided with processing (chamfering) into a rounded shape with their corners removed. A measure is thus provided to reduce the load on the transport belt 401 and the occurrence of abrasion powder.

(Operation of the Cooling Unit)

In the configuration shown in FIG. 1, the transport belt 401 is first rotated counterclockwise in the drawing to rotate the transport belt 402 in the clockwise direction in the drawing. In this state, the printing paper which has been transported from the heating fixing unit 105 is nipped between the transport belts 401 and 402, so that the printing paper is transported in the rightward direction in the drawing.

At this juncture, the printing paper is pressed against the transport belt 401 by the function of the pressing roll group 406, so that the transport belt 401 is pressed against the heat sink 403. In consequence, the heat of the printing surface (surface with an image formed thereon) of the printing paper is radiated to the heat sink 403 through the transport belt 401, so that the printing paper whose temperature has risen by the heat in the heating fixing unit 105 is cooled. The cooled printing paper is discharged from the cooling device 107 in the rightward direction in the drawing.

In addition, air flows between adjacent fins of the heat sink 403 by the function of the fans 510 to 512 to effect heat radiation from the heat sink 403. Part of the air current due to the function of the fans 510 to 512 also flows through the passages 505 and 506. In addition, as the air flows through the interiors of the passages 505 and 506, portions of the heat sink 403 which come into contact with this air are air-cooled.

(Function of Removing Abrasion Powder in Heat Sink)

In the above-described cooling action, the transport belt 401, while being pressed against the heat sink 403 and brought into contact with the heat sink 403, is moved with respect to the heat sink 403. At this juncture, the surface of the transport belt 401 is rubbed by the edges of the heat sink 403, and abrasion dust of the transport belt 401 is produced. This abrasion dust is produced on both the upstream-side edge and the downstream-side edge of the heat sink 403, but the occurrence is more noticeable on the upstream side.

This abrasion powder is blown away by the air current flowing through the passages 505 and 506 and is sucked by the fans 510 to 512. It should be noted that air filters for capturing dust and the like are respectively disposed on the exhaust side of the fans 510 to 512, and the aforementioned abrasion powder is captured by these air filters.

(First Modification)

Figure 4:
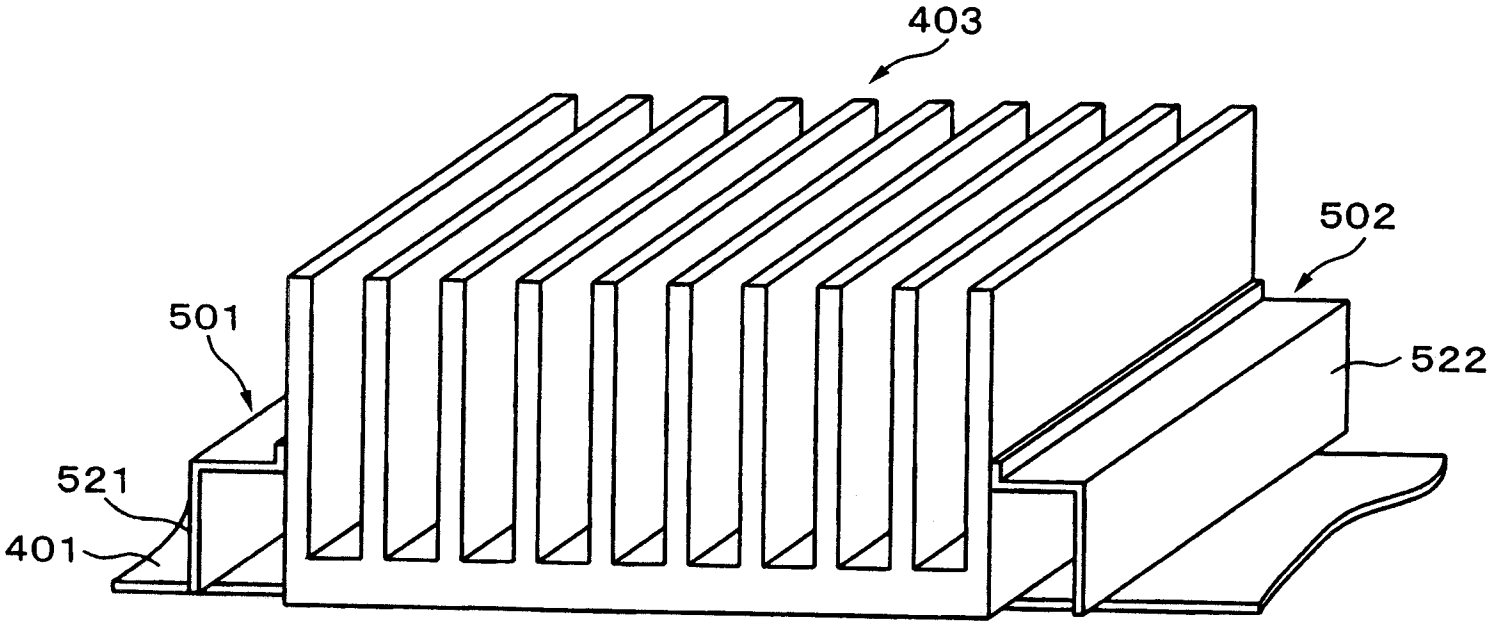
FIG. 4 is a perspective view illustrating an example of the cooling device.

FIG. 4 is a perspective view illustrating an example of a configuration provided with air ducts different in the structure from those of FIG. 3. In FIG. 4, portions denoted by the same reference numerals as those in FIGS. 2 and 3 are identical to the portions described with reference to FIGS. 2 and 3.

In this example, the configuration adopted is such that outer plates 521 and 522 for making up the air ducts 501 and 502 are formed of a resin (e.g., polyacetal), and their edges are brought into contact with the transport belt 401. In addition, those edge portions of the outer plates 521 and 522 which are bought into contact with the transport belt 401 are formed into shapes in which their corners are rounded by chamfering. The other arrangements are identical to those of the embodiment described with reference to FIGS. 1 to 3.

(Second Modification)

Figure 5A:
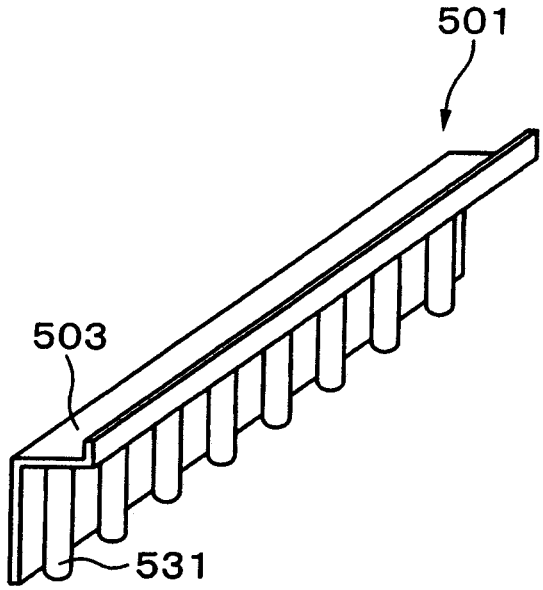
FIGS. 5A and 5B are perspective views illustrating examples of a configuration for generating turbulence.
Figure 5B:
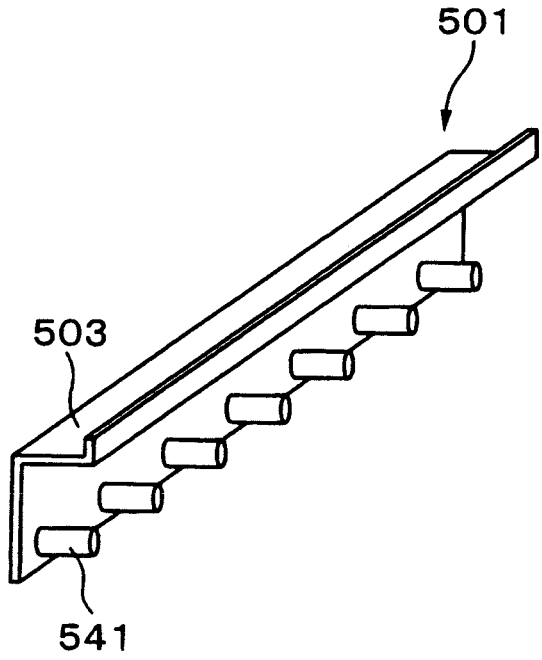

FIG. 5A is a perspective view illustrating an example in which cylindrical projections 531, which are used as projecting portions in this embodiment, are provided on an inner surface of the passage of the air duct 501. FIG. 5B is a perspective view illustrating an example in which projections 541 having a similar function are provided thereon. In these examples, as the plurality of projections 531 or 541 are arranged, turbulence is caused to occur in the flow of air flowing in the air duct 510 to thereby enhance the removal efficiency of the abrasion powder. The structure of the projections is not limited to the cylindrical shape and may be in another shape such as a plate shape.

(Third Modification)

Figure 6:
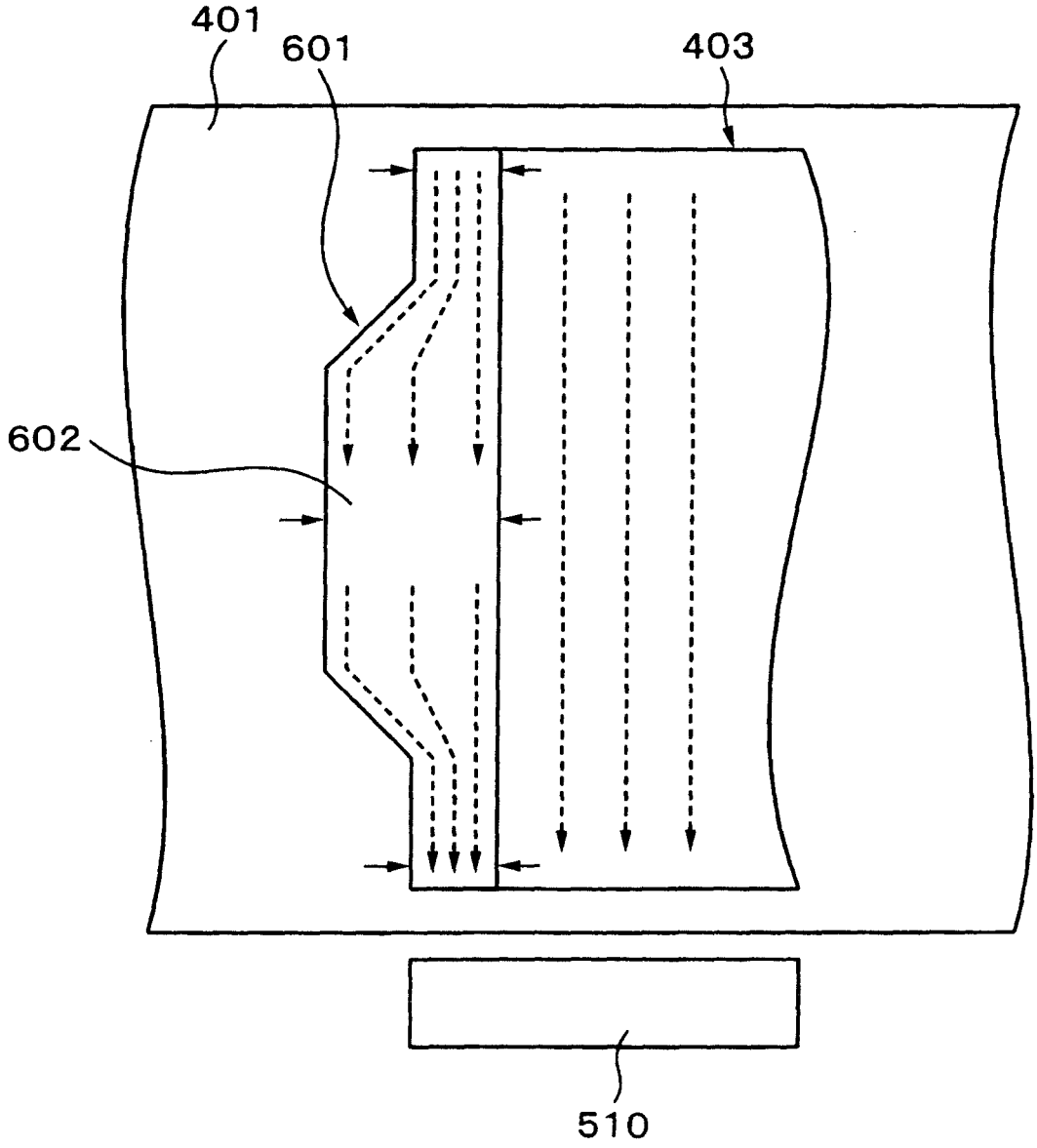
FIG. 6 is a conceptual diagram illustrating an example of the cooling device.

FIG. 6 shows a modification of the configuration shown in FIG. 2. FIG. 6 shows an example of a case in which the cross-sectional area of the passage is nonuniform. FIG. 6 corresponds to a top view of a portion shown in FIG. 2. FIG. 6 shows a portion of the heat sink 403, an air duct 601, the fan 510, and the transport belt 401. In this example, a measure is devised in the cross-sectional shape of a passage 602 of the air duct 601. Namely, the structure adopted is such that the width of the passage 602 (the width of the route along which air flows) is narrow at an inlet portion of the passage 602, wide in its central portion, and narrow again at its outlet portion. In other words, the structure is such that the cross-sectional area of the passage 602 is narrow at the inlet portion, wide in the central portion, and narrow again at the outlet portion.

According to the structure shown in FIG. 6, the flow rate in the vicinities of the inlet portion and the outlet portion of the passage 602 is higher in comparison with the flow rate in the central portion. The occurrence of abrasion powder is greater at both ends in the widthwise direction of the transport belt than at the central portion. Accordingly, by making the flow rate in the vicinities of the inlet portion and the outlet portion of the passage 602 higher than at the central portion, the removal of abrasion powder by blowing away can be effected more efficiently than in the case which is not provided with this arrangement.

(Fourth Modification)

Figure 7:
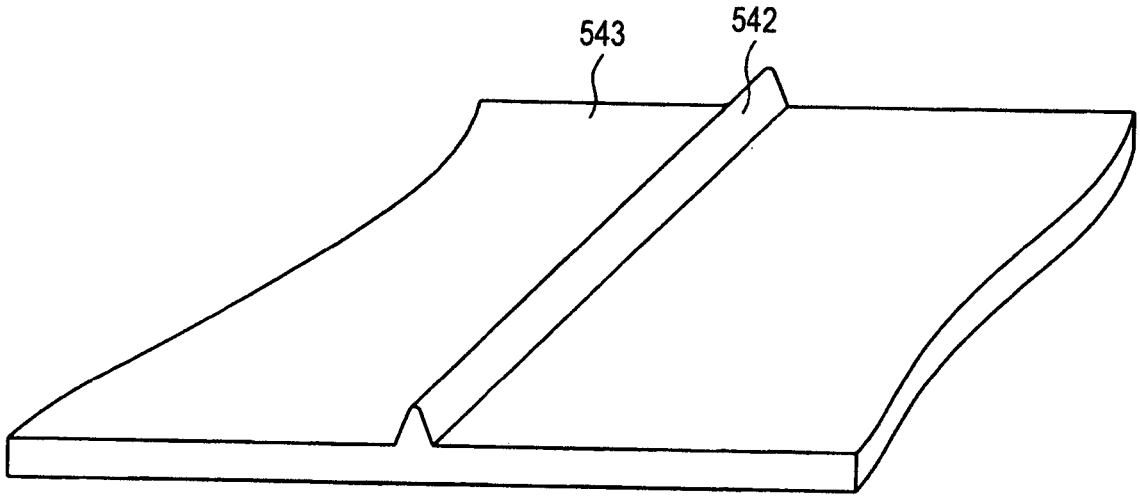
FIG. 7 is a conceptual diagram illustrating an example of a transport belt.

Next, a description will be given of a case in which a projecting portion is provided on that surface of the transport belt 401 which comes into contact with the heat sink 403. FIG. 7 is a conceptual diagram illustrating an example of the configuration of the transport belt. FIG. 7 shows a transport belt 543 which can be used instead of the transport belt 401 shown in FIGS. 1 and 2.

A projection 542, which extends in the widthwise direction of the transport belt 543 and is used as a projecting portion in this embodiment, is formed on that surface of the transport belt 543 which comes into contact with the heat sink 403. The projection 542 is, for example, 1 mm in height, and its apex portion has a rounded shape provided with chamfering. In addition, the side surfaces of the projection 542 which come into contact with the heat sink 403 are not vertical, but are formed as inclined surfaces whose angle with respect to a vertical line perpendicular to the belt surface is 10 to 30° or thereabouts. The number of the projections 542 is not limited, but it is necessary to adjust the timing of transport of the printing paper so that the projection 542 and the printing paper will not overlap. As the projection comes into contact with the edge of the heat sink 403, the abrasion powder adhered to the edge of the heat sink 403 is scraped off.

Figure 8:
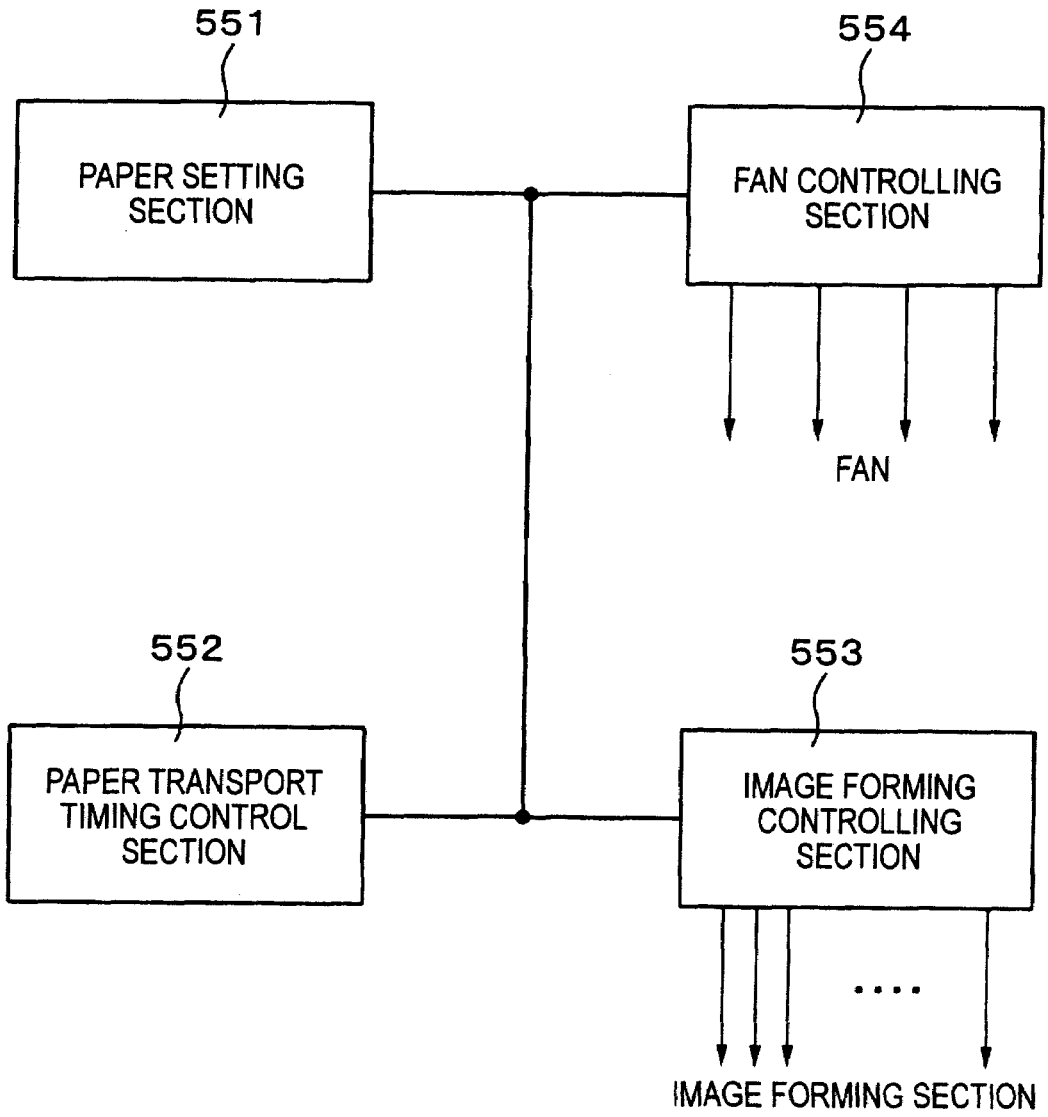
FIG. 8 is a conceptual diagram illustrating an example of a control system.

FIG. 8 is a conceptual diagram illustrating an example of a control system in the case where the configuration shown in FIG. 7 is adopted. In FIG. 8, a paper setting section 551 acquires information concerning the printing paper for forming an image thereon. A paper transport timing control section 552 is an example of a controlling section that controls the feeding section so that the projecting portion of the transporting section and the recording material will not overlap. The paper transport timing control section 552 outputs a signal for controlling a timing for feeding the printing paper from the recording material accommodating unit 101 shown in FIG. 1 to the transport path, to the drive mechanism of the feed roll 16 for feeding the printing paper from the recording material accommodating unit 101. An image formation controlling section 553 controls image formation processing in the image forming section 10. A fan controlling section 554 controls the operation of the fans 510 to 512.

(Operation)

Figure 9:
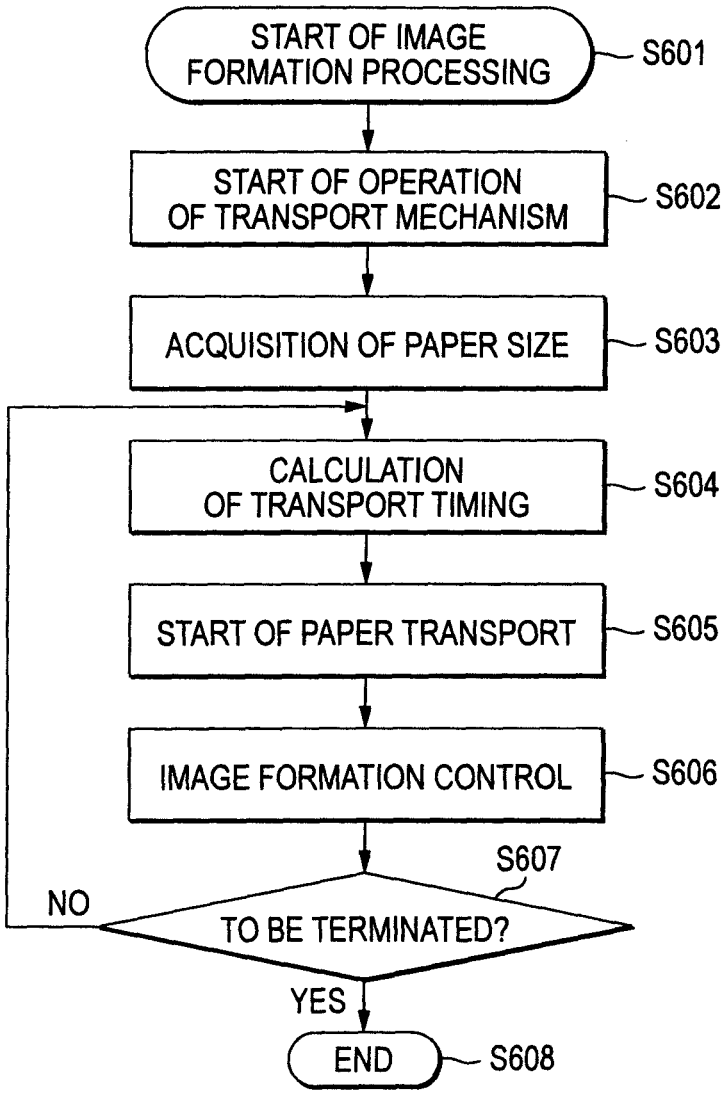
FIG. 9 is a flowchart illustrating an example of the operation which is executed by the control system.

Hereafter, a description will be given of an example of the operation which is executed by the control system shown in FIG. 8. FIG. 9 is a flowchart illustrating an example of the operation which is executed by the control system shown in FIG. 8. When image formation processing is started (Step S601), the operation of the transport roller and the like necessary for transporting the printing paper on the transport path 103, the rotation of the photoconductor drum in the image forming section 10, and the operation of the heating fixing unit 105 and the cooling device 107 are started (Step S602). In addition, the rotation of the fans 510 to 512 is started by the function of the fan controlling section 554.

Next, in the paper setting section 551, information concerning the printing paper subject to image formation (paper size and paper quality) is acquired (Step S603). Next, an arithmetic operation in which at which timing the printing paper is to be fed from the recording material accommodating unit 101 to the transport path 103 is calculated on the basis of the acquired information concerning the printing paper is carried out in the paper transport timing control section 552 (Step S604). In this arithmetic operation, the timing is calculated for feeding the printing paper 102 from the recording material accommodating unit 101 toward the cooling device 107 so that the printing paper will not overlap with the projection 542 shown in FIG. 7 at the stage when the printing paper reached the cooling device 107.

After the result of the arithmetic operation for calculating the transport timing has been obtained, a control signal is sent from the paper transport timing control section 552 to the drive mechanism of the feed roll 16 on the basis of this result, to start the transport of the printing paper (Step S605). Then, the toner image forming processing onto the printing paper in the image forming section 10 is controlled by the control signal from the image formation controlling section 553 (Step S606), and this toner image is heated and fixed by the heating fixing unit 105.

The printing paper subjected to heating/fixing processing is cooled in the cooling device 107, and is discharged in the rightward direction in the drawing. At the time of this cooling in the cooling device 107, since the timing of the feeding of the printing paper 102 from the first recording material accommodating unit 101 is adjusted by making use of the result of the arithmetic operation carried out in Step S604, the printing paper in the state of being pressed against the transport belt 401 does not overlap with the projection 542 shown in FIG. 7.

After Step S606, if the processing of image formation is to be terminated, the operation proceeds to Step S608 to end the processing. In addition, if the processing of image formation is to be effected for ensuing printing paper, the processing in and after Step S604 is repeated.

As a method for ensuring that the printing paper does not overlap with the projection 542 shown in FIG. 7 at the stage when the printing paper has reached the cooling device 107, it is possible to cite a method in which the transport speed of the transport belt 401 is adjusted at a stage before the printing paper reaches the cooling device 107, so as to adjust the position of the projection 542 at the stage when the printing paper reaches there.

(Fifth Modification)

In the illustration shown in FIG. 1, during the image forming operation, the number of revolutions of the fans 510 to 512 is controlled so that an air volume suitable for cooling the recording material will flow to the heat sink 403, to thereby execute a cooling mode. Then, at a stage when the number of sheets of the processed recording material has reached a predetermined number, the number of revolutions of the fans 510 to 512 is changed to a value allowing an air volume suitable for blowing away the abrasion powder to be obtained, to thereby execute a cleaning mode. As a result, the cooling efficiency, suppression of wasteful power consumption, and effective removal of the abrasion powder are realized with a good balance.

In this case, a unit that counts the number of sheets of the recording material for which image formation has been carried out is disposed to count the number of sheets of the processed recording material. In addition, the number of revolutions of the fans 510 to 512 during the cooling mode and during the cleaning mode is controlled by the function of the fan controlling section 554 by adopting the control system shown in FIG. 8.

(Sixth Modification)

Figure 10A:
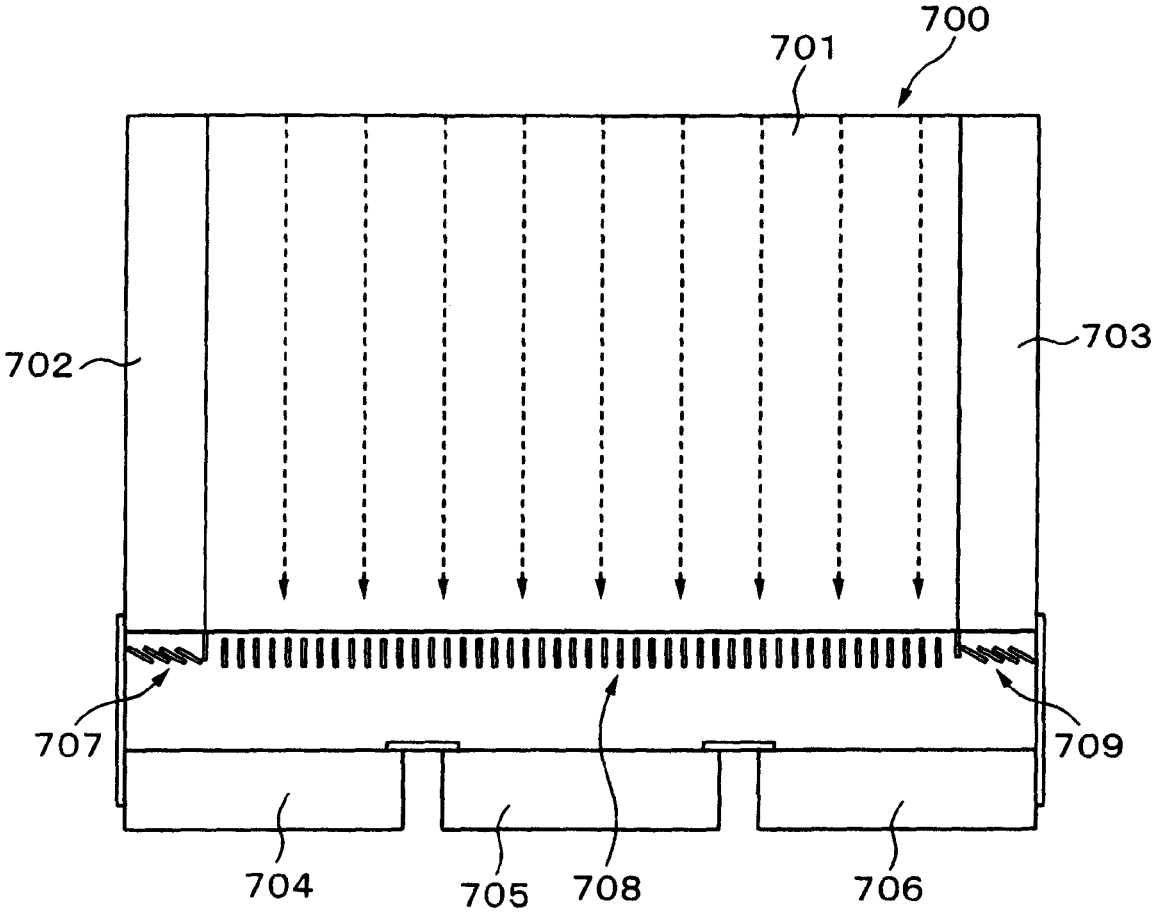
FIG. 10 is a conceptual diagram illustrating an example of the cooling device.
Figure 10B:
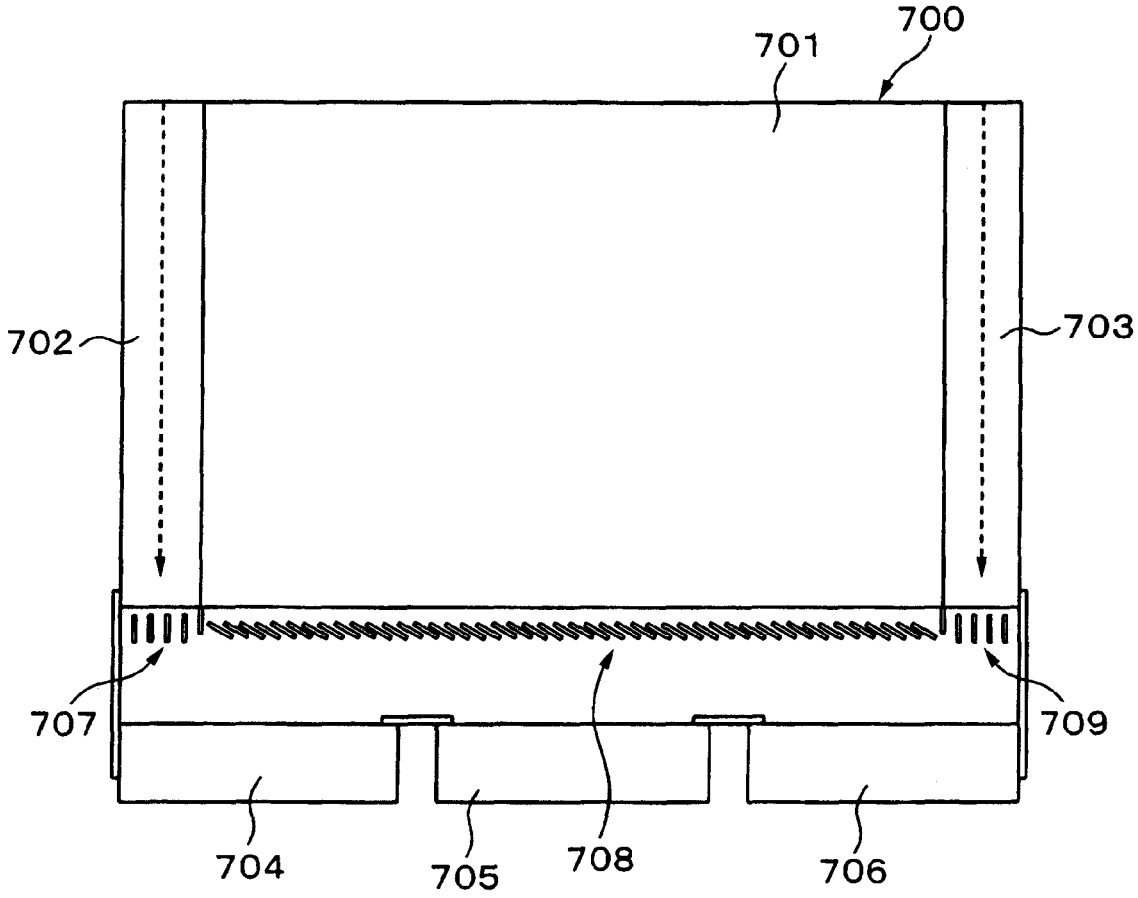

Hereafter, a description will be given of an example in which a change over is effected between the cooling mode and the cleaning mode by changing over the flow of air to the fans. FIGS. 10A and 10B are top views illustrating an example of the cooling device. FIG. 10A shows the state of the cooling mode, and FIG. 10B shows the state of the cleaning mode.

FIGS. 10A and 10B show a cooling device 700. The cooling device 700 has a heat sink 701 similar to the heat sink 403 shown in FIG. 1. Air ducts 702 and 703 similar to those shown in FIG. 1 are respectively disposed on the upstream side and the downstream side, as viewed in the transporting direction of the recording material, of the heat sink 701.

In this example, airflow path opening/closing means 707 to 709 are disposed between the heat sink 701 and fans 704 to 706. The airflow path opening/closing means 707 to 709 have a slatted shutter structure (similar to that of a jalousie), and function as shutters for opening or closing airflow paths.

FIG. 10A shows a state in which airflow paths between, on the one hand, the air ducts 702 and 703 and, on the other hand, the fans 704 to 706 are closed, while the airflow path between the heat sink 701 and the fans 704 to 706 is open. This state shown in FIG. 10A is one example of the cooling mode for effecting the cooling of the heat sink 701.

FIG. 10B shows a state in which the airflow paths between, on the one hand, the air ducts 702 and 703 and, on the other hand, the fans 704 to 706 are open, while the airflow path between the heat sink 701 and the fans 704 to 706 is closed. This state shown in FIG. 10B is one example of the cleaning mode in which air is allowed to flow through the interiors of the air ducts 702 and 703, and the abrasion powder on the unillustrated transport belt is removed by this air flow.

(Other Modifications)

In the illustration shown in FIG. 1, an example has been shown of the case in which the image forming section 10 has the function of forming a color image. However, in the case of exclusive use for monochromatic images, only one image forming unit may be used. In addition, as the image forming section, it is possible to adopt a configuration in which an image is not transferred directly from the photoconductor drum onto the recording medium, but an image is temporarily transferred from the photoconductor drum onto a transfer belt and is then transferred onto the recording material. Furthermore, as the cooling means, it is possible to use in combination a fan and a forced cooling means using a Peltier device or water cooling. Still further, the air duct may be disposed only on the upstream side of the heat sink.

The present invention can be used for an image forming apparatus.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A recording material cooling device comprising:

a transporting section that transports a recording material;

a heat radiation section that radiates heat of the recording material through the transporting section, the heat radiation section coming into contact with the transporting section;

an air current generating section that generates an air current which flows through the heat radiation section; and a passage that is constituted by a space including an end portion of a contacting portion where the transporting section and the heat radiation section are brought into contact with each other, the passage being formed with a gap from the transporting section and to flow a portion of the air current at the end portion, wherein the gap between the passage and the transporting section is closed by a gap closing member.

2. The recording material cooling device according to claim 1, which further comprises a projecting portion that is provided in the passage and forms turbulence in the air current flowing through an interior of the passage.

3. The recording material cooling device according to claim 2, wherein a cross-sectional area of the passage is nonuniform.

4. The recording material cooling device according to claim 3, wherein an air volume of the air current flowing through the passage comprises a first air volume and a second air volume different from the first air volume.

5. The recording material cooling device according to claim 2, wherein an air volume of the air current flowing through the passage comprises a first air volume and a second air volume different from the first air volume.

6. The recording material cooling device according to claim 1, wherein a cross-sectional area of the passage is nonuniform.

7. The recording material cooling device according to claim 6, wherein an air volume of the air current flowing through the passage comprises a first air volume and a second air volume different from the first air volume.

8. The recording material cooling device according to claim 1, wherein an air volume of the air current flowing through the passage comprises a first air volume and a second air volume different from the first air volume.

9. The recording material cooling device according to claim 1, wherein the transporting section is an endless belt-shaped member, an outer surface of the endless belt-shaped member is adapted to come into contact with the recording material, a projecting portion is provided on an inner surface of the endless belt-shaped member, and the inner surface of the endless belt-shaped member is adapted to come into contact with the heat radiation section.

10. An image forming apparatus comprising:

an image forming section that forms an image on a recording material;

the recording material cooling device according to claim 9 disposed on a downstream side of the image forming section;

a feeding section that feeds the recording material toward the recording material cooling device; and a controlling section that controls the feeding section such that the projecting portion and the recording material do not overlap.

11. An image forming apparatus comprising:

an image forming section that forms an image on a recording material;

a fixing section that fixes the image by applying heat to the recording material; and the recording material cooling device according to claim 1 disposed on a downstream side of the fixing section.

12. The recording material cooling device according to claim 1, wherein the gap closing member includes a resin plate.

13. A recording material cooling device comprising:

a transporting section that transports a recording material;

a heat radiation section that radiates heat of the recording material through the transporting section, the heat radiation section coming into contact with the transporting section;

an air current generating section that generates an air current which flows through the heat radiation section; and a passage that is constituted by a space including an end portion of a contacting portion where the transporting section and the heat radiation section are brought into contact with each other, the passage being formed to flow a portion of the air current at the end portion;

wherein the passage is constituted so that abrasion dust generated from the transporting section being rubbed with an edge of the heat radiation section is accumulated in the passage.

* * * * *